US009525220B1

(12) United States Patent
Burris

(10) Patent No.: US 9,525,220 B1
(45) Date of Patent: Dec. 20, 2016

(54) COAXIAL CABLE CONNECTOR

(71) Applicant: CORNING OPTICAL COMMUNICATIONS RF LLC, Hickory, NC (US)

(72) Inventor: Donald Andrew Burris, Peoria, AZ (US)

(73) Assignee: Corning Optical Communications LLC, Hickory, NC (US)

( * ) Notice: Subject to any disclaimer, the term of this patent is extended or adjusted under 35 U.S.C. 154(b) by 0 days.

(21) Appl. No.: 14/951,623

(22) Filed: Nov. 25, 2015

(51) Int. Cl.
*H01R 9/05* (2006.01)
*H01R 43/16* (2006.01)

(52) U.S. Cl.
CPC ..... *H01R 9/05* (2013.01); *H01R 43/16* (2013.01)

(58) Field of Classification Search
CPC ..... H01R 13/59; H01R 9/518
USPC ..... 439/584, 583, 578
See application file for complete search history.

(56) References Cited

U.S. PATENT DOCUMENTS

| | | | |
|---|---|---|---|
| 331,169 | A | 11/1885 | Thomas |
| 346,958 | A | 8/1886 | Stone |
| 459,951 | A | 9/1891 | Warner |
| 589,216 | A | 8/1897 | McKee |
| 1,371,742 | A | 3/1921 | Dringman |
| 1,488,175 | A | 3/1924 | Strandell |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 1,959,302 | A | 5/1934 | Paige |
| 2,013,526 | A | 9/1935 | Schmitt |
| 2,059,920 | A | 11/1936 | Weatherhead, Jr. |
| 2,102,495 | A | 12/1937 | England |
| 2,258,528 | A | 10/1941 | Wurzburger |
| 2,258,737 | A | 10/1941 | Browne |

(Continued)

FOREIGN PATENT DOCUMENTS

| | | |
|---|---|---|
| CA | 2096710 | 11/1994 |
| CN | 201149936 | 11/2008 |

(Continued)

OTHER PUBLICATIONS

Corning Gilbert 2004 OEM Coaxial Products Catalog, Quick Disconnects, 2 pages.

(Continued)

*Primary Examiner* — Phuong Dinh

(57) ABSTRACT

A coaxial connector having an axially moveable shell in opposition to a separate and distinct body component wherein the moveable shell contains a gripping member capable of having the front portion displaced radially inwardly by the body so that the gripping member is positioned within the connector body and between the connector body and the coaxial cable and secures the cable to the connector and environmentally seals the junction while at the same time the shell contains a structure to move a rear portion of the gripping member radially outwardly upon compression. In some embodiments disclosed herein the shell contains a structure to prevent a rear portion of the gripping member from moving radially inwardly upon compression. Other connector shell embodiments may be made from a one-piece stamping instead of a machined component and thereby deliver a manufacturing cost savings.

20 Claims, 6 Drawing Sheets

(56) References Cited

U.S. PATENT DOCUMENTS

| | | | |
|---|---|---|---|
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,705,652 | A | 4/1955 | Kaiser |
| 2,743,505 | A | 5/1956 | Hill |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,785,384 | A | 3/1957 | Wickesser |
| 2,805,399 | A | 9/1957 | Leeper |
| 2,816,949 | A | 12/1957 | Curtiss |
| 2,870,420 | A | 1/1959 | Malek |
| 2,878,039 | A | 3/1959 | Hoegee et al. |
| 2,881,406 | A | 4/1959 | Arson |
| 2,963,536 | A | 12/1960 | Kokalas |
| 3,001,169 | A | 9/1961 | Blonder |
| 3,015,794 | A | 1/1962 | Kishbaugh |
| 3,051,925 | A | 8/1962 | Felts |
| 3,091,748 | A | 5/1963 | Takes et al. |
| 3,094,364 | A | 6/1963 | Lingg |
| 3,103,548 | A | 9/1963 | Concelman |
| 3,106,548 | A | 10/1963 | Lavalou |
| 3,140,106 | A | 7/1964 | Thomas et al. |
| 3,161,451 | A | 12/1964 | Neidecker |
| 3,184,706 | A | 5/1965 | Atkins |
| 3,193,309 | A | 7/1965 | Morris |
| 3,194,292 | A | 7/1965 | Borowsky |
| 3,196,382 | A | 7/1965 | Morello, Jr. |
| 3,206,540 | A | 9/1965 | Cohen |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,756 | A | 10/1966 | O'Keefe et al. |
| 3,281,757 | A | 10/1966 | Bonhomme |
| 3,290,069 | A | 12/1966 | Davis |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,667 | A | 10/1967 | Shreve |
| 3,350,677 | A | 10/1967 | Daum |
| 3,355,698 | A | 11/1967 | Keller |
| 3,372,364 | A | 3/1968 | O'Keefe et al. |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,499,671 | A | 3/1970 | Osborne |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,596,933 | A | 8/1971 | Luckenbill |
| 3,601,776 | A | 8/1971 | Curl |
| 3,603,912 | A | 9/1971 | Kelly |
| 3,614,711 | A | 10/1971 | Anderson et al. |
| 3,622,952 | A | 11/1971 | Hilbert |
| 3,629,792 | A | 12/1971 | Dorrell |
| 3,633,150 | A | 1/1972 | Schwartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,671,926 | A | 6/1972 | Nepovim |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,694,793 | A | 9/1972 | Concelman |
| 3,697,930 | A | 10/1972 | Shirey |
| 3,706,958 | A | 12/1972 | Blanchenot |
| 3,708,186 | A | 1/1973 | Takagi et al. |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,761,870 | A | 9/1973 | Drezin et al. |
| 3,778,535 | A | 12/1973 | Forney, Jr. |
| 3,781,762 | A | 12/1973 | Quackenbush |
| 3,781,898 | A | 12/1973 | Holloway |
| 3,783,178 | A | 1/1974 | Philibert et al. |
| 3,787,796 | A | 1/1974 | Barr |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,824,026 | A | 7/1974 | Gaskins |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,847,463 | A | 11/1974 | Hayward et al. |
| 3,854,003 | A | 12/1974 | Duret |
| 3,854,789 | A | 12/1974 | Kaplan |
| 3,858,156 | A | 12/1974 | Zarro |
| 3,879,102 | A | 4/1975 | Horak |
| 3,886,301 | A | 5/1975 | Cronin et al. |
| 3,907,335 | A | 9/1975 | Burge et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,937,547 | A | 2/1976 | Lee-Kemp |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 3,986,736 | A | 10/1976 | Takagi et al. |
| 4,012,105 | A | 3/1977 | Biddle |
| 4,017,139 | A | 4/1977 | Nelson |
| 4,022,966 | A | 5/1977 | Gajajiva |
| 4,030,742 | A | 6/1977 | Eidelberg et al. |
| 4,030,798 | A | 6/1977 | Paoli |
| 4,032,177 | A | 6/1977 | Anderson |
| 4,045,706 | A | 8/1977 | Daffner et al. |
| 4,046,451 | A | 9/1977 | Juds et al. |
| 4,053,200 | A | 10/1977 | Pugner |
| 4,056,043 | A | 11/1977 | Sriramamurty et al. |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,100,943 | A | 7/1978 | Terada et al. |
| 4,106,839 | A | 8/1978 | Cooper |
| 4,109,126 | A | 8/1978 | Halbeck |
| 4,118,097 | A | 10/1978 | Budnick |
| 4,125,308 | A | 11/1978 | Schilling |
| 4,126,372 | A | 11/1978 | Hashimoto et al. |

(56) References Cited

U.S. PATENT DOCUMENTS 4,131,332 A 12/1978 Hogendobler et al.
4,136,897 A 1/1979 Haluch
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,173,385 A 11/1979 Fenn et al.
4,174,875 A 11/1979 Wilson et al.
4,187,481 A 2/1980 Bourtos
4,193,655 A 3/1980 Herrmann, Jr.
4,194,338 A 3/1980 Trafton
4,197,628 A 4/1980 Conti et al.
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,239,318 A 12/1980 Schwartz
4,250,348 A 2/1981 Kitagawa
4,260,212 A 4/1981 Ritchie
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris
4,310,211 A 1/1982 Bunnell et al.
4,322,121 A 3/1982 Riches et al.
4,326,768 A 4/1982 Punako
4,326,769 A 4/1982 Dorsey et al.
4,334,730 A 6/1982 Colwell et al.
4,339,166 A 7/1982 Dayton
4,345,375 A 8/1982 Hayward
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,428,639 A 1/1984 Hillis
4,444,453 A 4/1984 Kirby et al.
4,447,107 A 5/1984 Major et al.
4,452,503 A 6/1984 Forney, Jr.
4,456,323 A 6/1984 Pitcher et al.
4,459,881 A 7/1984 Hughes, Jr.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,491,685 A 1/1985 Drew et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,553,877 A 11/1985 Edvardsen
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,623,205 A 11/1986 Barron
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,666,231 A 5/1987 Sheesley et al.
4,668,043 A 5/1987 Saba et al.
4,670,574 A 6/1987 Malcolm
4,673,236 A 6/1987 Musolff et al.
4,674,809 A 6/1987 Hollyday et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gullusser et al.
4,703,988 A 11/1987 Raux et al.
4,713,021 A 12/1987 Kobler
4,717,355 A 1/1988 Mattis
4,720,155 A 1/1988 Schildkraut et al.
4,728,301 A 3/1988 Hemmer et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,126 A 4/1988 Gutter et al.
4,746,305 A 5/1988 Nomura
4,747,656 A 5/1988 Miyahara et al.
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.

(56) References Cited

U.S. PATENT DOCUMENTS

| | | | |
|---|---|---|---|
| 4,867,489 | A | 9/1989 | Patel |
| 4,867,706 | A | 9/1989 | Tang |
| 4,869,679 | A | 9/1989 | Szegda |
| 4,874,331 | A | 10/1989 | Iverson |
| 4,881,912 | A | 11/1989 | Thommen et al. |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,934,960 | A | 6/1990 | Capp et al. |
| 4,938,718 | A | 7/1990 | Guendel |
| 4,941,846 | A | 7/1990 | Guimond et al. |
| 4,952,174 | A | 8/1990 | Sucht et al. |
| 4,957,456 | A | 9/1990 | Olson et al. |
| 4,963,105 | A | 10/1990 | Lewis et al. |
| 4,964,805 | A | 10/1990 | Gabany |
| 4,964,812 | A | 10/1990 | Siemon et al. |
| 4,973,265 | A | 11/1990 | Heeren |
| 4,976,632 | A | 12/1990 | Riches |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 4,992,061 | A | 2/1991 | Brush, Jr. et al. |
| 5,002,503 | A | 3/1991 | Campbell et al. |
| 5,007,861 | A | 4/1991 | Stirling |
| 5,011,422 | A | 4/1991 | Yeh |
| 5,011,432 | A | 4/1991 | Sucht et al. |
| 5,018,822 | A | 5/1991 | Freismuth et al. |
| 5,021,010 | A | 6/1991 | Wright |
| 5,024,606 | A | 6/1991 | Ming-Hwa |
| 5,030,126 | A | 7/1991 | Hanlon |
| 5,037,328 | A | 8/1991 | Karlovich |
| 5,046,964 | A | 9/1991 | Welsh et al. |
| 5,052,947 | A | 10/1991 | Brodie et al. |
| 5,055,060 | A | 10/1991 | Down et al. |
| 5,059,139 | A | 10/1991 | Spinner |
| 5,059,747 | A | 10/1991 | Bawa et al. |
| 5,062,804 | A | 11/1991 | Jamet et al. |
| 5,066,248 | A | 11/1991 | Gaver, Jr. et al. |
| 5,067,912 | A | 11/1991 | Bickford et al. |
| 5,073,129 | A | 12/1991 | Szegda |
| 5,074,809 | A | 12/1991 | Rousseau et al. |
| 5,080,600 | A | 1/1992 | Baker et al. |
| 5,083,943 | A | 1/1992 | Tarrant |
| 5,088,937 | A | 2/1992 | Gabany |
| 5,120,260 | A | 6/1992 | Jackson |
| 5,127,853 | A | 7/1992 | McMills et al. |
| 5,131,862 | A | 7/1992 | Gershfeld |
| 5,137,470 | A | 8/1992 | Doles |
| 5,137,471 | A | 8/1992 | Verespej et al. |
| 5,139,440 | A | 8/1992 | Volk et al. |
| 5,141,448 | A | 8/1992 | Mattingly et al. |
| 5,141,451 | A | 8/1992 | Down |
| 5,149,274 | A | 9/1992 | Gallusser et al. |
| 5,150,924 | A | 9/1992 | Yokomatsu et al. |
| 5,154,636 | A | 10/1992 | Vaccaro et al. |
| 5,161,993 | A | 11/1992 | Leibfried, Jr. |
| 5,166,477 | A | 11/1992 | Perin, Jr. et al. |
| 5,167,545 | A | 12/1992 | O'Brien et al. |
| 5,169,323 | A | 12/1992 | Kawai et al. |
| 5,176,530 | A | 1/1993 | Reylek |
| 5,176,533 | A | 1/1993 | Sakurai et al. |
| 5,181,161 | A | 1/1993 | Hirose et al. |
| 5,183,417 | A | 2/1993 | Bools |
| 5,186,501 | A | 2/1993 | Mano |
| 5,186,655 | A | 2/1993 | Glenday et al. |
| 5,195,904 | A | 3/1993 | Cyvoct |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| D335,487 | S | 5/1993 | Volk et al. |
| 5,207,602 | A | 5/1993 | McMills et al. |
| 5,215,477 | A | 6/1993 | Weber et al. |
| 5,217,391 | A | 6/1993 | Fisher, Jr. |
| 5,217,392 | A | 6/1993 | Hosler, Sr. |
| 5,217,393 | A | 6/1993 | Del Negro et al. |
| 5,221,216 | A | 6/1993 | Gabany et al. |
| 5,227,587 | A | 7/1993 | Paterek |
| 5,247,424 | A | 9/1993 | Harris et al. |
| 5,269,701 | A | 12/1993 | Leibfried, Jr. |
| 5,281,762 | A | 1/1994 | Long et al. |
| 5,283,853 | A | 2/1994 | Szegda |
| 5,284,449 | A | 2/1994 | Vaccaro |
| 5,294,864 | A | 3/1994 | Do |
| 5,295,864 | A | 3/1994 | Birch et al. |
| 5,316,348 | A | 5/1994 | Franklin |
| 5,316,494 | A | 5/1994 | Flanagan et al. |
| 5,318,459 | A | 6/1994 | Shields |
| 5,321,205 | A | 6/1994 | Bawa et al. |
| 5,334,032 | A | 8/1994 | Myers et al. |
| 5,334,051 | A | 8/1994 | Devine et al. |
| 5,338,225 | A | 8/1994 | Jacobsen et al. |
| 5,342,218 | A | 8/1994 | McMills et al. |
| 5,352,134 | A | 10/1994 | Jacobsen et al. |
| 5,354,217 | A | 10/1994 | Gabel et al. |
| 5,362,250 | A | 11/1994 | McMills et al. |
| 5,362,251 | A | 11/1994 | Bielak |
| 5,366,260 | A | 11/1994 | Wartluft |
| 5,371,819 | A | 12/1994 | Szegda |
| 5,371,821 | A | 12/1994 | Szegda |
| 5,371,827 | A | 12/1994 | Szegda |
| 5,380,211 | A | 1/1995 | Kawaguchi et al. |
| 5,389,005 | A | 2/1995 | Kodama |
| 5,393,244 | A | 2/1995 | Szegda |
| 5,397,252 | A | 3/1995 | Wang |
| 5,413,504 | A | 5/1995 | Kloecker et al. |
| 5,431,583 | A | 7/1995 | Szegda |
| 5,435,745 | A | 7/1995 | Booth |
| 5,435,751 | A | 7/1995 | Papenheim et al. |
| 5,435,760 | A | 7/1995 | Miklos |
| 5,439,386 | A | 8/1995 | Ellis et al. |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,474,478 | A | 12/1995 | Ballog |
| 5,475,921 | A | 12/1995 | Johnston |
| 5,488,268 | A | 1/1996 | Bauer et al. |
| 5,490,033 | A | 2/1996 | Cronin |
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,511,305 | A | 4/1996 | Garner |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,571,028 | A | 11/1996 | Szegda |
| 5,586,910 | A | 12/1996 | Del Negro et al. |
| 5,595,499 | A | 1/1997 | Zander et al. |
| 5,598,132 | A | 1/1997 | Stabile |
| 5,607,320 | A | 3/1997 | Wright |
| 5,607,325 | A | 3/1997 | Toma |
| 5,609,501 | A | 3/1997 | McMills et al. |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,649,723 | A | 7/1997 | Larsson |
| 5,651,698 | A | 7/1997 | Locati et al. |
| 5,651,699 | A | 7/1997 | Holliday |
| 5,653,605 | A | 8/1997 | Woehl et al. |

(56) References Cited

U.S. PATENT DOCUMENTS 5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,743,131 A 4/1998 Holliday et al.
5,746,617 A 5/1998 Porter, Jr. et al.
5,746,619 A 5/1998 Harting et al.
5,759,618 A 6/1998 Taylor
5,769,652 A 6/1998 Wider
5,769,662 A 6/1998 Stabile et al.
5,774,344 A 6/1998 Casebolt
5,775,927 A 7/1998 Wider
5,788,289 A 8/1998 Cronley
5,791,698 A 8/1998 Wartluft et al.
5,797,633 A 8/1998 Katzer et al.
5,817,978 A 10/1998 Hermant et al.
5,863,220 A 1/1999 Holliday
5,874,603 A 2/1999 Arkles
5,877,452 A 3/1999 McConnell
5,879,191 A 3/1999 Burris
5,882,226 A 3/1999 Bell et al.
5,890,924 A 4/1999 Endo
5,897,795 A 4/1999 Lu et al.
5,906,511 A 5/1999 Bozzer et al.
5,917,153 A 6/1999 Geroldinger
5,921,793 A 7/1999 Phillips
5,938,465 A 8/1999 Fox, Sr.
5,944,548 A 8/1999 Saito
5,951,327 A 9/1999 Marik
5,954,708 A 9/1999 Lopez et al.
5,957,716 A 9/1999 Buckley et al.
5,967,852 A 10/1999 Follingstad et al.
5,975,479 A 11/1999 Suter
5,975,591 A 11/1999 Guest
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,036,540 A 3/2000 Beloritsky
6,042,422 A 3/2000 Youtsey
6,048,229 A 4/2000 Lazaro, Jr.
6,053,743 A 4/2000 Mitchell et al.
6,053,769 A 4/2000 Kubota et al.
6,053,777 A 4/2000 Boyle
6,062,607 A 5/2000 Bartholomew
6,080,015 A 6/2000 Andreescu
6,083,030 A 7/2000 Wright
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,093,043 A 7/2000 Gray et al.
6,095,828 A 8/2000 Burland
6,095,841 A 8/2000 Felps
6,123,550 A 9/2000 Burkert et al.
6,123,567 A 9/2000 McCarthy
6,126,487 A 10/2000 Rosenberger et al.
6,132,234 A 10/2000 Waidner et al.
6,142,812 A 11/2000 Hwang
6,146,197 A 11/2000 Holliday et al.
6,152,752 A 11/2000 Fukuda
6,152,753 A 11/2000 Johnson et al.
6,153,830 A 11/2000 Montena
6,162,995 A 12/2000 Bachle et al.
6,164,977 A 12/2000 Lester
6,174,206 B1 1/2001 Yentile et al.
6,183,298 B1 2/2001 Henningsen
6,199,913 B1 3/2001 Wang
6,199,920 B1 3/2001 Neustadtl
6,210,216 B1 4/2001 Tso-Chin et al.
6,210,219 B1 4/2001 Zhu et al.
6,210,222 B1 4/2001 Langham et al.
6,217,383 B1 4/2001 Holland et al.
6,238,240 B1 5/2001 Yu
6,239,359 B1 5/2001 Lilienthal, II et al.
6,241,553 B1 6/2001 Hsia
6,250,942 B1 6/2001 Lemke et al.
6,250,974 B1 6/2001 Kerek
6,257,923 B1 7/2001 Stone et al.
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,352,448 B1 3/2002 Holliday et al.
6,358,077 B1 3/2002 Young
6,361,348 B1 3/2002 Hall et al.
6,361,364 B1 3/2002 Holland et al.
6,375,509 B2 4/2002 Mountford
6,379,183 B1 4/2002 Ayres et al.
6,394,840 B1 5/2002 Gassauer et al.
6,396,367 B1 5/2002 Rosenberger
D458,904 S 6/2002 Montena
6,398,571 B1 6/2002 Nishide et al.
6,406,330 B2 6/2002 Bruce
6,409,534 B1 6/2002 Weisz-Margulescu
D460,739 S 7/2002 Fox
D460,740 S 7/2002 Montena
D460,946 S 7/2002 Montena
D460,947 S 7/2002 Montena
D460,948 S 7/2002 Montena
6,422,884 B1 7/2002 Babasick et al.
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,443,763 B1 9/2002 Richet
6,450,829 B1 9/2002 Weisz-Margulescu
6,454,463 B1 9/2002 Halbach
6,464,526 B1 10/2002 Seufert et al.
6,464,527 B2 10/2002 Volpe et al.
6,467,816 B1 10/2002 Huang
6,468,100 B1 10/2002 Meyer et al.
6,491,546 B1 12/2002 Perry
D468,696 S 1/2003 Montena
6,506,083 B1 1/2003 Bickford et al.
6,510,610 B2 1/2003 Losinger
6,520,800 B1 2/2003 Michelbach et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,637,101 B2 10/2003 Hathaway et al.
6,645,011 B2 11/2003 Schneider et al.
6,663,397 B1 12/2003 Lin et al.
6,676,446 B2 1/2004 Montena
6,683,253 B1 1/2004 Lee
6,683,773 B2 1/2004 Montena
6,692,285 B2 2/2004 Islam
6,692,286 B1 2/2004 De Cet
6,695,636 B2 2/2004 Hall et al.
6,705,875 B2 3/2004 Berghorn et al.
6,705,884 B1 3/2004 McCarthy
6,709,280 B1 3/2004 Gretz
6,709,289 B2 3/2004 Huber et al.
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira

(56) References Cited

U.S. PATENT DOCUMENTS

| | | | |
|---|---|---|---|
| 6,743,040 | B1 | 6/2004 | Nakamura |
| 6,749,454 | B2 | 6/2004 | Schmidt et al. |
| 6,751,081 | B1 | 6/2004 | Kooiman |
| 6,752,633 | B2 | 6/2004 | Aizawa et al. |
| 6,761,571 | B2 | 7/2004 | Hida |
| 6,767,248 | B1 | 7/2004 | Hung |
| 6,769,926 | B1 | 8/2004 | Montena |
| 6,780,029 | B1 | 8/2004 | Gretz |
| 6,780,042 | B1 | 8/2004 | Badescu et al. |
| 6,780,052 | B2 | 8/2004 | Montena et al. |
| 6,780,068 | B2 | 8/2004 | Bartholoma et al. |
| 6,783,394 | B1 | 8/2004 | Holliday |
| 6,786,767 | B1 | 9/2004 | Fuks et al. |
| 6,790,081 | B2 | 9/2004 | Burris et al. |
| 6,793,528 | B2 | 9/2004 | Lin et al. |
| 6,796,847 | B2 | 9/2004 | AbuGhazaleh |
| 6,802,738 | B1 | 10/2004 | Henningsen |
| 6,805,583 | B2 | 10/2004 | Holliday et al. |
| 6,805,584 | B1 | 10/2004 | Chen |
| 6,808,415 | B1 | 10/2004 | Montena |
| 6,817,272 | B2 | 11/2004 | Holland |
| 6,817,896 | B2 | 11/2004 | Derenthal |
| 6,817,897 | B2 | 11/2004 | Chee |
| 6,827,608 | B2 | 12/2004 | Hall et al. |
| 6,830,479 | B2 | 12/2004 | Holliday |
| 6,848,115 | B2 | 1/2005 | Sugiura et al. |
| 6,848,939 | B2 | 2/2005 | Stirling |
| 6,848,940 | B2 | 2/2005 | Montena |
| 6,848,941 | B2 | 2/2005 | Wlos et al. |
| 6,884,113 | B1 | 4/2005 | Montena |
| 6,884,115 | B2 | 4/2005 | Malloy |
| 6,887,102 | B1 | 5/2005 | Burris et al. |
| 6,916,200 | B2 | 7/2005 | Burris et al. |
| 6,929,265 | B2 | 8/2005 | Holland et al. |
| 6,929,508 | B1 | 8/2005 | Holland |
| 6,935,866 | B2 | 8/2005 | Kerekes et al. |
| 6,939,169 | B2 | 9/2005 | Islam et al. |
| 6,942,516 | B2 | 9/2005 | Shimoyama et al. |
| 6,942,520 | B2 | 9/2005 | Barlian et al. |
| 6,945,805 | B1 | 9/2005 | Bollinger |
| 6,948,976 | B2 | 9/2005 | Goodwin et al. |
| 6,953,371 | B2 | 10/2005 | Baker et al. |
| 6,955,563 | B1 | 10/2005 | Croan |
| D511,497 | S | 11/2005 | Murphy et al. |
| D512,024 | S | 11/2005 | Murphy et al. |
| D512,689 | S | 12/2005 | Murphy et al. |
| 6,971,912 | B2 | 12/2005 | Montena et al. |
| 7,008,263 | B2 | 3/2006 | Holland |
| 7,018,216 | B1 | 3/2006 | Clark et al. |
| 7,018,235 | B1 | 3/2006 | Burris et al. |
| 7,029,326 | B2 | 4/2006 | Montena |
| D521,454 | S | 5/2006 | Murphy et al. |
| 7,063,565 | B2 | 6/2006 | Ward |
| 7,070,447 | B1 | 7/2006 | Montena |
| 7,077,697 | B2 | 7/2006 | Kooiman |
| 7,077,699 | B2 | 7/2006 | Islam et al. |
| 7,086,897 | B2 | 8/2006 | Montena |
| 7,090,525 | B1 | 8/2006 | Morana |
| 7,094,114 | B2 | 8/2006 | Kurimoto |
| 7,097,499 | B1 | 8/2006 | Purdy |
| 7,102,868 | B2 | 9/2006 | Montena |
| 7,108,547 | B2 | 9/2006 | Kisling et al. |
| 7,108,548 | B2 | 9/2006 | Burris et al. |
| 7,112,078 | B2 | 9/2006 | Czikora |
| 7,112,093 | B1 | 9/2006 | Holland |
| 7,114,990 | B2 | 10/2006 | Bence et al. |
| 7,118,285 | B2 | 10/2006 | Fenwick et al. |
| 7,118,382 | B2 | 10/2006 | Kerekes et al. |
| 7,118,416 | B2 | 10/2006 | Montena et al. |
| 7,125,283 | B1 | 10/2006 | Lin |
| 7,128,603 | B2 | 10/2006 | Burris et al. |
| 7,128,604 | B2 | 10/2006 | Hall |
| 7,131,867 | B1 | 11/2006 | Foster et al. |
| 7,131,868 | B2 | 11/2006 | Montena |
| 7,140,645 | B2 | 11/2006 | Cronley |
| 7,144,271 | B1 | 12/2006 | Burris et al. |
| 7,144,272 | B1 | 12/2006 | Burris et al. |
| 7,147,509 | B1 | 12/2006 | Burris et al. |
| 7,153,159 | B2 | 12/2006 | Burris et al. |
| 7,156,696 | B1 | 1/2007 | Montena |
| 7,161,785 | B2 | 1/2007 | Chawgo |
| 7,165,974 | B2 | 1/2007 | Kooiman |
| 7,173,121 | B2 | 2/2007 | Fang |
| 7,179,121 | B1 | 2/2007 | Burris et al. |
| 7,179,122 | B2 | 2/2007 | Holliday |
| 7,182,639 | B2 | 2/2007 | Burris |
| 7,183,639 | B2 | 2/2007 | Mihara et al. |
| 7,189,097 | B2 | 3/2007 | Benham |
| 7,189,114 | B1 | 3/2007 | Burris et al. |
| 7,192,308 | B2 | 3/2007 | Rodrigues et al. |
| 7,229,303 | B2 | 6/2007 | Vermoesen et al. |
| 7,238,047 | B2 | 7/2007 | Saetele et al. |
| 7,252,536 | B2 | 8/2007 | Lazaro, Jr. et al. |
| 7,252,546 | B1 | 8/2007 | Holland |
| 7,255,598 | B2 | 8/2007 | Montena et al. |
| 7,261,594 | B2 | 8/2007 | Kodama et al. |
| 7,264,502 | B2 | 9/2007 | Holland |
| 7,278,882 | B1 | 10/2007 | Li |
| 7,288,002 | B2 | 10/2007 | Rodrigues et al. |
| 7,291,033 | B2 | 11/2007 | Hu |
| 7,297,023 | B2 | 11/2007 | Chawgo |
| 7,299,550 | B2 | 11/2007 | Montena |
| 7,303,435 | B2 | 12/2007 | Burris et al. |
| 7,311,555 | B1 | 12/2007 | Burris et al. |
| 7,318,609 | B2 | 1/2008 | Naito et al. |
| 7,322,846 | B2 | 1/2008 | Camelio |
| 7,322,851 | B2 | 1/2008 | Brookmire |
| 7,329,139 | B2 | 2/2008 | Benham |
| 7,331,820 | B2 | 2/2008 | Burris et al. |
| 7,335,058 | B1 | 2/2008 | Burris et al. |
| 7,347,129 | B1 | 3/2008 | Youtsey |
| 7,347,726 | B2 | 3/2008 | Wlos |
| 7,347,727 | B2 | 3/2008 | Wlos et al. |
| 7,347,729 | B2 | 3/2008 | Thomas et al. |
| 7,351,088 | B1 | 4/2008 | Qu |
| 7,357,641 | B2 | 4/2008 | Kerekes et al. |
| 7,364,462 | B2 | 4/2008 | Holland |
| 7,371,112 | B2 | 5/2008 | Burris et al. |
| 7,371,113 | B2 | 5/2008 | Burris et al. |
| 7,375,533 | B2 | 5/2008 | Gale |
| 7,387,524 | B2 | 6/2008 | Cheng |
| 7,393,245 | B2 | 7/2008 | Palinkas et al. |
| 7,396,249 | B2 | 7/2008 | Kauffman |
| 7,404,737 | B1 | 7/2008 | Youtsey |
| 7,410,389 | B2 | 8/2008 | Holliday |
| 7,416,415 | B2 | 8/2008 | Hart et al. |
| 7,438,327 | B2 | 10/2008 | Auray et al. |
| 7,452,239 | B2 | 11/2008 | Montena |
| 7,455,550 | B1 | 11/2008 | Sykes |
| 7,458,850 | B1 | 12/2008 | Burris et al. |
| 7,458,851 | B2 | 12/2008 | Montena |
| 7,462,068 | B2 | 12/2008 | Amidon |
| 7,467,980 | B2 | 12/2008 | Chiu |
| 7,476,127 | B1 | 1/2009 | Wei |
| 7,478,475 | B2 | 1/2009 | Hall |
| 7,479,033 | B1 | 1/2009 | Sykes et al. |
| 7,479,035 | B2 | 1/2009 | Bence et al. |
| 7,484,988 | B2 | 2/2009 | Ma et al. |
| 7,484,997 | B2 | 2/2009 | Hofling |
| 7,488,210 | B1 | 2/2009 | Burris et al. |
| 7,494,355 | B2 | 2/2009 | Hughes et al. |
| 7,497,729 | B1 | 3/2009 | Wei |
| 7,500,868 | B2 | 3/2009 | Holland et al. |
| 7,500,873 | B1 | 3/2009 | Hart |
| 7,507,116 | B2 | 3/2009 | Laerke et al. |
| 7,507,117 | B2 | 3/2009 | Amidon |
| 7,513,788 | B2 | 4/2009 | Camelio |
| 7,537,482 | B2 | 5/2009 | Burris et al. |
| 7,540,759 | B2 | 6/2009 | Liu et al. |
| 7,544,094 | B1 | 6/2009 | Paglia et al. |
| 7,563,133 | B2 | 7/2009 | Stein |
| 7,566,236 | B2 | 7/2009 | Malloy et al. |
| 7,568,945 | B2 | 8/2009 | Chee et al. |
| 7,578,693 | B2 | 8/2009 | Yoshida et al. |

(56) References Cited

U.S. PATENT DOCUMENTS 7,588,454 B2 9/2009 Nakata et al.
7,607,942 B1 10/2009 Van Swearingen
7,625,227 B1 12/2009 Henderson et al.
7,632,143 B1 12/2009 Islam
7,635,283 B1 12/2009 Islam
7,648,393 B2 1/2010 Burris et al.
7,651,376 B2 1/2010 Schreier
7,674,132 B1 3/2010 Chen
7,682,177 B2 3/2010 Berthet
7,694,420 B2 4/2010 Ehret et al.
7,714,229 B2 5/2010 Burris et al.
7,726,996 B2 6/2010 Burris et al.
7,727,011 B2 6/2010 Montena et al.
7,749,021 B2 7/2010 Brodeur
7,753,705 B2 7/2010 Montena
7,753,710 B2 7/2010 George
7,753,727 B1 7/2010 Islam et al.
7,758,356 B2 7/2010 Burris et al.
7,758,370 B1 7/2010 Flaherty
7,794,275 B2 9/2010 Rodrigues
7,806,714 B2 10/2010 Williams et al.
7,806,725 B1 10/2010 Chen
7,811,133 B2 10/2010 Gray
7,814,654 B2 10/2010 Pichler
D626,920 S 11/2010 Purdy et al.
7,824,216 B2 11/2010 Purdy
7,828,594 B2 11/2010 Burris et al.
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,845,980 B1 12/2010 Amidon
7,850,472 B2 12/2010 Friedrich et al.
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube
7,892,024 B1 2/2011 Chen
7,914,326 B2 3/2011 Sutter
7,918,687 B2 4/2011 Paynter et al.
7,927,135 B1 4/2011 Wlos
7,934,955 B1 5/2011 Hsia
7,938,662 B2 5/2011 Burris et al.
7,942,695 B1 5/2011 Lu
7,950,958 B2 5/2011 Mathews
7,950,961 B2 5/2011 Chabalowski et al.
7,955,126 B2 6/2011 Bence et al.
7,972,158 B2 7/2011 Wild et al.
7,972,176 B2 7/2011 Burris et al.
7,982,005 B2 7/2011 Ames et al.
8,011,955 B1 9/2011 Lu
8,025,518 B2 9/2011 Burris et al.
8,029,315 B2 10/2011 Purdy et al.
8,029,316 B2 10/2011 Snyder et al.
8,037,599 B2 10/2011 Pichler
8,047,872 B2 11/2011 Burris et al.
8,062,044 B2 11/2011 Montena et al.
8,062,063 B2 11/2011 Malloy et al.
8,070,504 B2 12/2011 Amidon et al.
8,075,337 B2 12/2011 Malloy et al.
8,075,338 B1 12/2011 Montena
8,079,860 B1 12/2011 Zraik
8,087,954 B2 1/2012 Fuchs
8,113,875 B2 2/2012 Malloy et al.
8,113,879 B1 2/2012 Zraik
8,157,587 B2 4/2012 Paynter et al.
8,157,588 B1 4/2012 Rodrigues et al.
8,167,635 B1 5/2012 Mathews
8,167,636 B1 5/2012 Montena
8,172,612 B2 5/2012 Bence et al.
8,177,572 B2 5/2012 Feye-Hohmann
8,192,237 B2 6/2012 Purdy et al.
8,206,172 B2 6/2012 Katagiri et al.
D662,893 S 7/2012 Haberek et al.
8,231,412 B2 7/2012 Paglia et al.
8,262,408 B1 9/2012 Kelly
8,272,893 B2 9/2012 Burris et al.
8,287,310 B2 10/2012 Burris et al.
8,287,320 B2 10/2012 Purdy et al.
8,313,345 B2 11/2012 Purdy
8,313,353 B2 11/2012 Purdy et al.
8,317,539 B2 11/2012 Stein
8,319,136 B2 11/2012 Byron et al.
8,323,053 B2 12/2012 Montena
8,323,058 B2 12/2012 Flaherty et al.
8,323,060 B2 12/2012 Purdy et al.
8,337,229 B2 12/2012 Montena
8,366,481 B2 2/2013 Ehret et al.
8,366,482 B2 2/2013 Burris et al.
8,376,769 B2 2/2013 Holland et al.
D678,844 S 3/2013 Haberek
8,398,421 B2 3/2013 Haberek et al.
8,430,688 B2 4/2013 Montena et al.
8,449,326 B2 5/2013 Holland et al.
8,465,322 B2 6/2013 Purdy
8,469,739 B2 6/2013 Rodrigues et al.
8,469,740 B2 6/2013 Ehret et al.
D686,164 S 7/2013 Haberek et al.
D686,576 S 7/2013 Haberek et al.
8,475,205 B2 7/2013 Ehret et al.
8,480,430 B2 7/2013 Ehret et al.
8,480,431 B2 7/2013 Ehret et al.
8,485,845 B2 7/2013 Ehret et al.
8,506,325 B2 8/2013 Malloy et al.
8,506,525 B2 * 8/2013 Bosarge ..... A61B 17/00491 604/73
8,517,763 B2 8/2013 Burris et al.
8,517,764 B2 8/2013 Wei et al.
8,529,279 B2 9/2013 Montena
8,550,835 B2 10/2013 Montena
8,568,163 B2 10/2013 Burris et al.
8,568,165 B2 10/2013 Wei et al.
8,591,244 B2 11/2013 Thomas et al.
8,597,050 B2 12/2013 Flaherty et al.
8,622,776 B2 1/2014 Morikawa
8,636,529 B2 1/2014 Stein
8,636,541 B2 1/2014 Chastain et al.
8,647,136 B2 2/2014 Purdy et al.
7,114,990 C1 4/2014 Bence et al.
8,690,603 B2 4/2014 Bence et al.
8,721,365 B2 5/2014 Holland
8,727,800 B2 5/2014 Holland et al.
8,758,050 B2 6/2014 Montena
8,777,658 B2 7/2014 Holland et al.
8,777,661 B2 7/2014 Holland et al.
8,858,251 B2 10/2014 Montena
8,888,526 B2 11/2014 Burris
8,920,192 B2 12/2014 Montena
6,558,194 C1 1/2015 Montena
6,848,940 C1 1/2015 Montena
9,017,101 B2 4/2015 Ehret et al.
8,172,612 C1 5/2015 Bence et al.
9,048,599 B2 6/2015 Burris
9,153,911 B2 10/2015 Burris et al.
9,166,348 B2 10/2015 Burris et al.
9,172,154 B2 10/2015 Burris
9,172,157 B2 10/2015 Burris
2001/0034143 A1 10/2001 Annequin
2001/0046802 A1 11/2001 Perry et al.
2001/0051448 A1 12/2001 Gonzales
2002/0013088 A1 1/2002 Rodrigues et al.
2002/0019161 A1 2/2002 Finke et al.
2002/0038720 A1 4/2002 Kai et al.
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland

(56) References Cited

U.S. PATENT DOCUMENTS

2004/0077215 A1 4/2004 Palinkas et al.
2004/0102089 A1 5/2004 Chee
2004/0137778 A1 7/2004 Mattheeuws et al.
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2006/0014425 A1 1/2006 Montena
2006/0099853 A1 5/2006 Sattele et al.
2006/0110977 A1 5/2006 Matthews
2006/0113107 A1 6/2006 Williams
2006/0154519 A1 7/2006 Montena
2006/0166552 A1 7/2006 Bence et al.
2006/0178046 A1 8/2006 Tusini
2006/0194465 A1 8/2006 Czikora
2006/1078034 8/2006 Shimirak
2006/0199040 A1 9/2006 Yamada
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0123101 A1 5/2007 Palinkas
2007/0155232 A1 7/2007 Burris et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0020635 A1* 1/2008 Chee ..... H01R 9/0521 439/578
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0289470 A1 11/2008 Aston
2008/0310026 A1 12/2008 Nakayama
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy
2010/0255721 A1 10/2010 Purdy et al.
2010/0279548 A1 11/2010 Montena et al.
2010/0297871 A1 11/2010 Haube
2010/0297875 A1 11/2010 Purdy et al.
2010/0304579 A1 12/2010 Kisling
2010/0323541 A1 12/2010 Amidon et al.
2011/0021072 A1 1/2011 Purdy
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1* 5/2011 Burris ..... H01R 9/0524 439/578
2011/0111626 A1 5/2011 Paglia et al.
2011/0117774 A1 5/2011 Malloy et al.
2011/0143567 A1 6/2011 Purdy et al.
2011/0151714 A1 6/2011 Flaherty et al.
2011/0230089 A1 9/2011 Amidon et al.
2011/0230091 A1 9/2011 Krenceski et al.
2011/0237123 A1 9/2011 Burris et al.
2011/0237124 A1 9/2011 Flaherty et al.
2011/0250789 A1 10/2011 Burris et al.
2011/0318958 A1 12/2011 Burris et al.
2012/0021642 A1 1/2012 Zraik
2012/0040537 A1 2/2012 Burris
2012/0045933 A1 2/2012 Youtsey
2012/0064768 A1 3/2012 Islam et al.
2012/0094530 A1 4/2012 Montena
2012/0100751 A1 4/2012 Montena
2012/0108098 A1 5/2012 Burris et al.
2012/0122329 A1 5/2012 Montena
2012/0129387 A1 5/2012 Holland et al.
2012/0171894 A1 7/2012 Malloy et al.
2012/0178289 A1 7/2012 Holliday
2012/0202378 A1 8/2012 Krenceski et al.
2012/0222302 A1 9/2012 Purdy et al.
2012/0225581 A1 9/2012 Amidon et al.
2012/0315788 A1 12/2012 Montena
2013/0065433 A1 3/2013 Burris
2013/0072057 A1 3/2013 Burris
2013/0178096 A1 7/2013 Matzen
2013/0273761 A1 10/2013 Ehret et al.
2014/0106612 A1 4/2014 Burris
2014/0106613 A1 4/2014 Burris
2014/0120766 A1 5/2014 Meister et al.
2014/0137393 A1 5/2014 Chastain et al.
2014/0148044 A1 5/2014 Balcer et al.
2014/0148051 A1 5/2014 Bence et al.
2014/0154907 A1 6/2014 Ehret et al.
2014/0273620 A1* 9/2014 Burris ..... H01R 9/05 439/578
2014/0298650 A1 10/2014 Chastain et al.
2014/0322968 A1 10/2014 Burris
2014/0342605 A1 11/2014 Burris et al.
2015/0118901 A1 4/2015 Burris
2015/0295331 A1 10/2015 Burris

FOREIGN PATENT DOCUMENTS

CN 201149937 11/2008
CN 201178228 1/2009
CN 201904508 7/2011
DE 47931 10/1888
DE 102289 7/1897
DE 1117687 11/1961
DE 2261973 6/1974
DE 3117320 4/1982
DE 3211008 10/1983
DE 9001608.4 4/1990
DE 4439852 5/1996
DE 19749130 8/1999
DE 19957518 9/2001
DE 10346914 5/2004

(56) References Cited

FOREIGN PATENT DOCUMENTS

| | | |
|---|---|---|
| EP | 115179 | 8/1984 |
| EP | 116157 | 8/1984 |
| EP | 167738 | 1/1986 |
| EP | 72104 | 2/1986 |
| EP | 223464 | 5/1987 |
| EP | 265276 | 4/1988 |
| EP | 350835 | 1/1990 |
| EP | 428424 | 5/1991 |
| EP | 867978 | 9/1998 |
| EP | 1069654 | 9/1998 |
| EP | 1094565 | 4/2001 |
| EP | 1115179 | 7/2001 |
| EP | 1191268 | 3/2002 |
| EP | 1455420 | 9/2004 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2204331 | 5/1974 |
| FR | 2232846 | 1/1975 |
| FR | 2462798 | 2/1981 |
| FR | 2494508 | 5/1982 |
| GB | 589697 | 6/1947 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 200215823 | 1/2002 |
| JP | 4129978 | 8/2008 |
| JP | 2009277571 | 11/2009 |
| JP | 4391268 | 12/2009 |
| JP | 4503793 | 7/2010 |
| KR | 100622526 | 9/2006 |
| TW | 427044 | 3/2001 |
| WO | 8700351 | 1/1987 |
| WO | 00/05785 | 2/2000 |
| WO | 186756 | 11/2001 |
| WO | 2069457 | 9/2002 |
| WO | 2004013883 | 2/2004 |
| WO | 2004098795 | 11/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2012162431 | 5/2011 |
| WO | 2011128665 | 10/2011 |
| WO | 2011128666 | 10/2011 |
| WO | 2013126629 | 8/2013 |

OTHER PUBLICATIONS

Digicon AVL Connector. ARRIS Group Inc. [online] 3 pages. Retrieved from the Internet: <URL: http://www.arrisi.com/special/digiconAVL.asp.

US Office Action, U.S. Appl. No. 10/997,218; Jul. 31, 2006, pp. 1-10.

Society of Cable Telecommunications Engineers, Engineering Committee, Interface Practices Subcommittee; American National Standard; ANSI/SCTE Jan. 2006; Specification for "F" Port, Female, Outdoor. Published Jan. 2006. 9 pages.

The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.

Notice of Allowance (Mail Date Mar. 20, 2012) for U.S. Appl. No. 13/117,843.

Search Report dated Jun. 6, 2014 pertaining to International application No. PCT/US2014/023374.

Search Report dated Apr. 9, 2014 pertaining to International application No. PCT/US2014/015934.

Society of Cable Telecommunications Engineers, Engineering Committee, Interface Practices Subcommittee; American National Standard; ANSI/SCTE Feb. 2006; "Specification for "F" Port, Female, Indoor". Published Feb. 2006. 9 pages.

PPC, "Next Generation Compression Connectors," pp. 1-6, Retrieved from http://www.tessco.com/yts/partnearnanufacturer list/vendors/ppc/pdf/ppc digital spread.pdf.

Patent Cooperation Treaty, International Search Report for PCT/US2013/070497, Feb. 11, 2014, 3 pgs.

Patent Cooperation Treaty, International Search Report for PCT/US2013/064515, 10 pgs.

Patent Cooperation Treaty, International Search Report for PCT/US2013/064512, Jan. 21, 2014, 11 pgs.

Huber+Suhner AG, RF Connector Guide: Understanding connector technology, 2007, Retrieved from http://www.ie.itcr.ac.cr/marin/lic/e14515/HUBER+SUENER_RF_Connector_Guide.pdf.

Slade, Paul G,. Electrical Contacts: Principles and Applications, 1999, Retrieved from http://books.google.com/books (table of contents only).

U.S. Reexamination Control No. 95/002,400 filed Sep. 15, 2012, regarding U.S. Pat. No. 8,192,237 filed Feb. 23, 2011 (Purdy et al.).

U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).

U.S. Inter Partes Review Case No. 2013-00343 filed Jun. 10, 2013, regarding U.S. Pat. No. 8,313,353 filed Apr. 30, 2012, claims 1-6 (Purdy et al.).

U.S. Inter Partes Review Case No. 2013-00340 filed Jun. 10, 2013, regarding U.S. Pat. No. 8,323,060 filed Jun. 14, claims 1-9 (Purdy et al.).

U.S. Inter Partes Review Case No. 2013-00347 filed Jun. 10, 2013, regarding U.S. Pat. No. 8,287,320 filed Dec. 8, 2009, claims 9, 17, 32 (Purdy et al.).

U.S. Inter Partes Review Case No. 2013-00345 filed Jun. 10, 2013, regarding U.S. Pat. No. 8,313,353 filed Apr. 30, 2012, claims 7-27 (Purdy et al.).

U.S. Inter Partes Review Case No. 2013-00342 filed Jun. 10, 2013, regarding U.S. Pat. No. 8,323,060 filed Jun. 14, 2012, claims 10-25 (Purdy et al.).

U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).

U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).

Office Action dated Jun. 12, 2014 pertaining to U.S. Appl. No. 13/795,737.

Office Action dated Aug. 25, 2014 pertaining to U.S. Appl. No. 13/605,481.

Election/Restrictions Requirement dated Jul. 31, 2014 pertaining to U.S. Appl. No. 13/652,969.

Office Action dated Aug. 29, 2014 pertaining to U.S. Appl. No. 13/827,522.

Election/Restrictions Requirement dated Jun. 20, 2014 pertaining to U.S. Appl. No. 13/795,780.

Office Action dated Sep. 19, 2014 pertaining to U.S. Appl. No. 13/795,780.

Office Action dated Oct. 6, 2014 pertaining to U.S. Appl. No. 13/732,679.

Corning Cabelcon waterproof CX3 7.0 QuickMount for RG6 cables; Cabelcon Connectors; www.cabelcom.dk; Mar. 15, 2012.

Maury Jr., M.; Microwave Coaxial Connector Technology: A Continuaing Evolution; Maury Microwave Corporation; Dec. 13, 2005; pp. 1-21; Maury Microwave Inc.

(56) References Cited

OTHER PUBLICATIONS

"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.
Office Action dated Mar. 19, 2015 pertaining to U.S. Appl. No. 13/795,780.
Patent Cooperation Treaty, International Search Report for PCT/US2014/037841, Mail Date Aug. 19, 2014, 3 pages.
Office Action dated Jun. 24, 2015 pertaining to U.S. Appl. No. 13/652,969.
Patent Cooperation Treaty, International Preliminary Report on Patentability for PCT/US2013/064512, mail date Apr. 30, 2015, 9 pages.
Patent Cooperation Treaty, International Preliminary Report on Patentability for PCT/US2013/064515, mail date Apr. 30, 2015, 8 pages.
Office Action dated Jun. 24, 2015 pertaining to U.S. Appl. No. 14/259,703.
Office Action dated Jul. 20, 2015 pertaining to U.S. Appl. No. 14/279,870.
Office Action dated Feb. 2, 2016 pertaining to U.S. Appl. No. 14/259,703.
Office Action dated Oct. 7, 2015 pertaining to U.S. Appl. No. 13/927,537.
Search Report dated Oct. 7, 2014 pertaining to International application No. PCT/US2014/043311.
Report on the Filing or Determination of an Action Regarding a Patent or Trademark regarding U.S. Pat. Nos. 8,313,353; 8,313,345; 8,323,060—Eastern District of Arkansas.
Report on the Filing or Determination of an Action Regarding a Patent or Trademark regarding U.S. Pat. Nos. 8,192,237; 8,287,320; 8,313,353; 8,323,060—Northern District of New York.
Report on the Filing or Determination of an Action Regarding a Patent or Trademark regarding U.S. Pat. No. 8,562,366—Northern District of New York.
Office Action dated Mar. 10, 2016 pertaining to U.S. Appl. No. 14/166,653.

* cited by examiner

COAXIAL CABLE CONNECTOR

BACKGROUND

1. Field

The present invention relates generally to coaxial cable connectors, and particularly to coaxial cable connectors including a compression mechanism for use with coaxial cables.

2. Technical Background

Coaxial cable connectors such as F-connectors are used to attach coaxial cable to another object such as an appliance or junction having a terminal adapted to engage the connector. Coaxial cable F-connectors are often used to terminate a drop cable in a cable television system. The coaxial cable typically includes a center conductor surrounded by a dielectric, in turn surrounded by a conductive grounding foil and/or braid (hereinafter referred to as a conductive grounding sheath); the conductive grounding sheath is itself surrounded by a protective outer jacket. The F-connector is secured over the prepared end of the jacketed coaxial cable, allowing the end of the coaxial cable to be connected with a terminal block, such as by a threaded connection or slidable engagement with a threaded terminal of a terminal block.

SUMMARY

A coaxial connector having an axially moveable shell in opposition to a separate and distinct body component wherein the moveable shell contains a gripping member capable of having the front portion displaced radially inwardly by the body so that the gripping member is positioned within the connector body and between the connector body and the coaxial cable and secures the cable to the connector and environmentally seals the junction while at the same time the shell contains a structure to move a rear portion of the gripping member radially outwardly upon compression. In some embodiments disclosed herein the shell contains a structure to prevent a rear portion of the gripping member from moving radially inwardly upon compression. Other connector shell embodiments may be made from a one-piece stamping instead of a machined component and thereby deliver a manufacturing cost savings.

In some embodiments, coaxial cable connectors for connecting a coaxial cable comprising an inner conductor, an insulator layer surrounding the inner conductor, an outer conductor layer surrounding the insulator layer and an outer jacket are provided. In one embodiment, the coaxial cable connector includes a body, a shell and a gripping member. The body includes a rear end, a front end, and an internal surface extending between the rear and front ends of the body, the internal surface defining a longitudinal opening. The shell includes a rear end, a front end surrounding at least a portion of the body, an inner surface defining a longitudinal opening extending between the rear and front ends of the shell and a forwardly angled surface, the shell being axially movable over an outside portion the body between a first rearward position and a second forward position. The gripping member is adapted to secure a coaxial cable to the coaxial cable connector, the gripping member disposed at least partially within the longitudinal opening of the shell, the gripping member comprising a front end, a rear end, an outer surface, an inner surface defining an opening therein. The forward angled surface of the shell is adapted to displace at least a portion of the rear end of the gripping member radially outwardly as the shell is moved from the first rearward position toward the second forward position.

In another embodiment, methods for securing a coaxial cable to a coaxial cable connector are provided. In one embodiment, the method includes inserting a coaxial cable through an inner bore of a body, shell and gripping member of coaxial cable connector. The body includes a rear end, a front end, and an internal surface extending between the rear and front ends of the body. The internal surface defines a longitudinal opening. The shell includes a rear end, a front end surrounding at least a portion of the body, an inner surface defining a longitudinal opening extending between the rear and front ends of the shell and a forwardly angled surface. The shell is axially movable over an outside portion the body between a first rearward position and a second forward position. The gripping member is disposed at least partially within the longitudinal opening of the shell. The gripping member includes a front end, a rear end, an outer surface and an inner surface defining an opening therein. The method further includes axially sliding the shell in a forward direction relative to the body. The forward angled surface of the shell is adapted to displace at least a portion of the rear end of the gripping member radially outwardly as the shell is moved from the first rearward position toward the second forward position.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate embodiments, and together with the description serve to explain principles and operation of the various embodiments.

Figure 5:
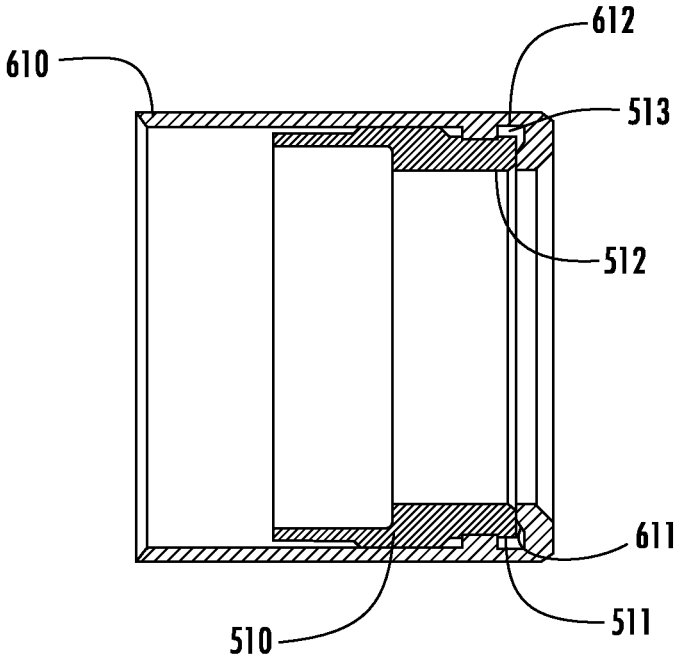
Figure 6:
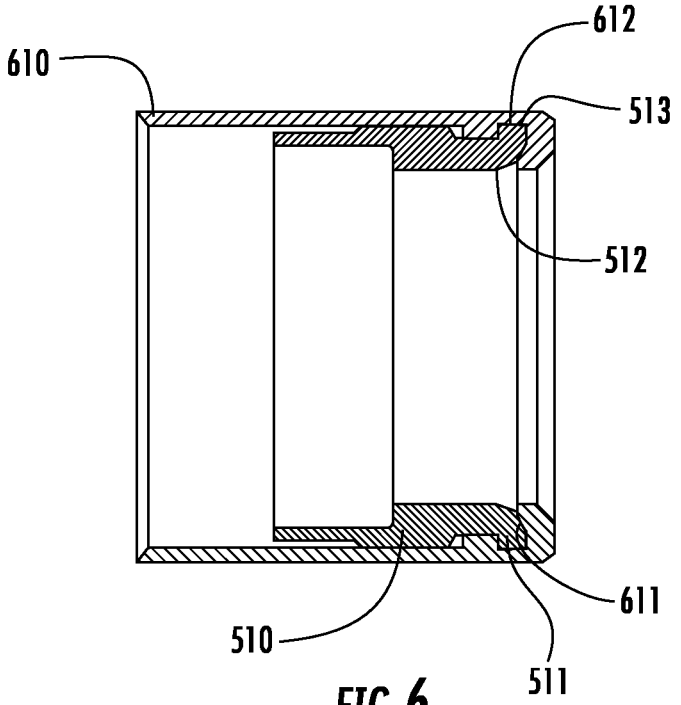
Figure 7:
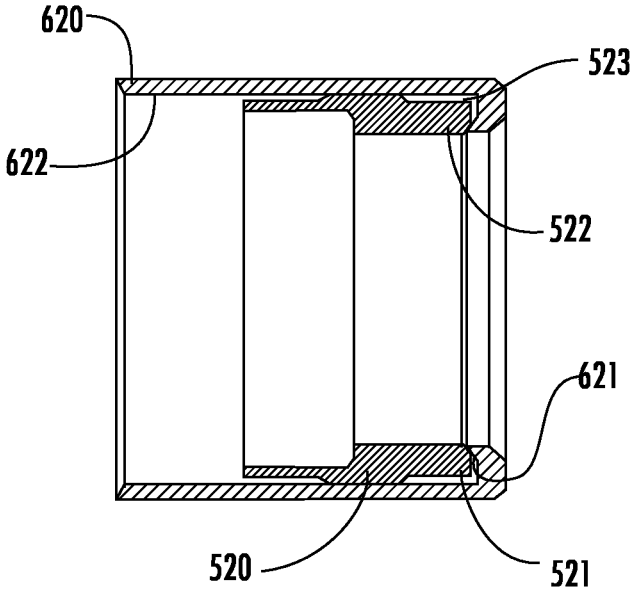
Figure 8:
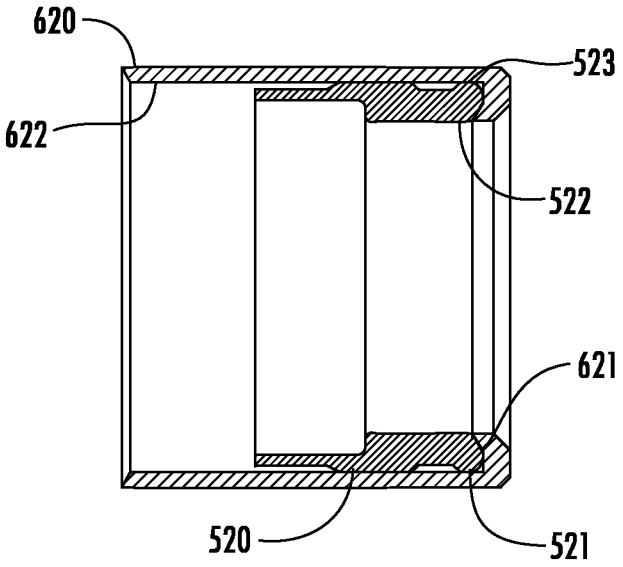
Figure 9:
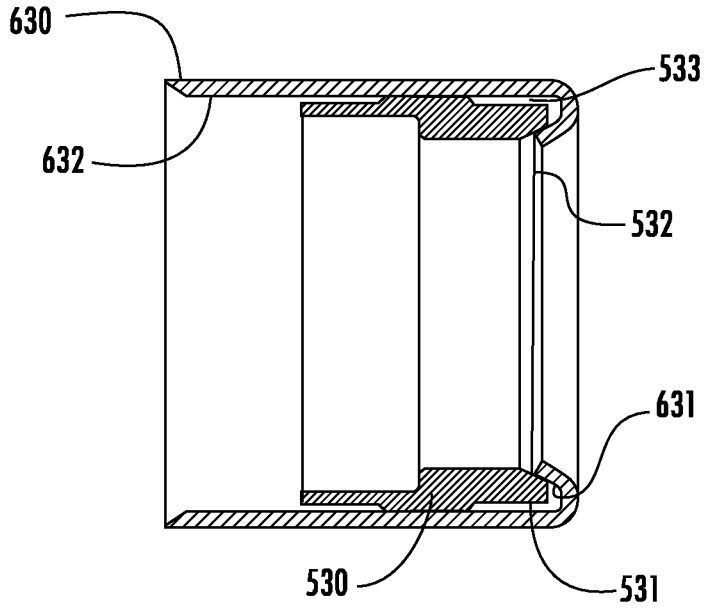
Figure 10:
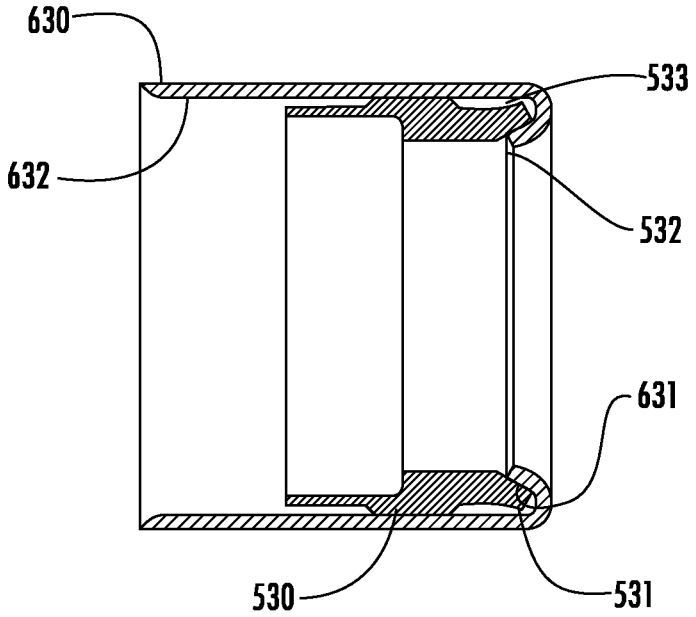
Figure 11:
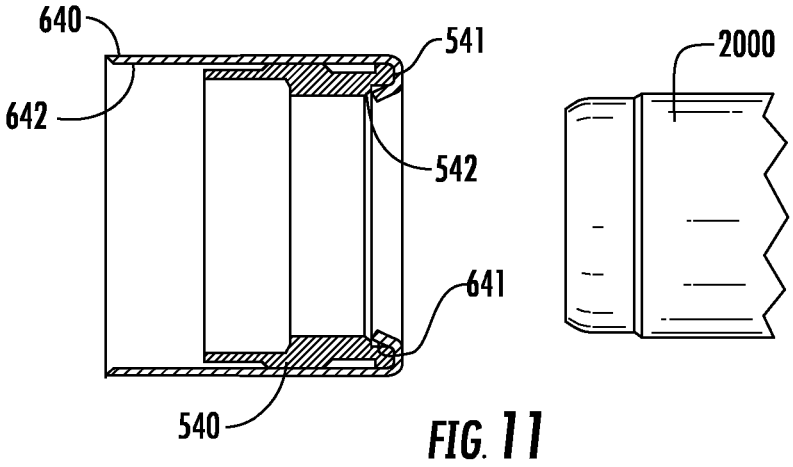
Figure 12:
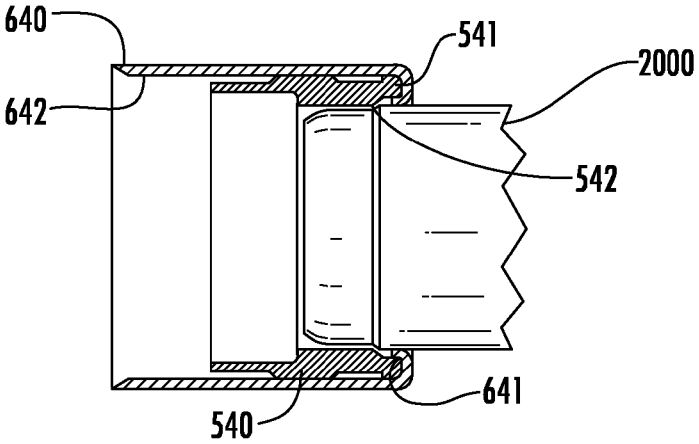
Figure 13:
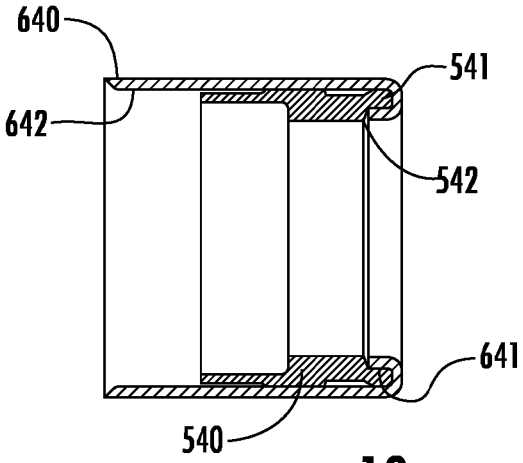

a FIG. 5 schematically depicts a cross section of another example embodiment of a gripping member and a shell of a coaxial cable connector as a sub-assembly in a first uncompressed position according to one or more embodiments described and illustrated herein;

FIG. 6 schematically depicts a cross section of the example embodiment of the gripping member and the shell shown in FIG. 5 as a sub-assembly in a second compressed position according to one or more embodiments described and illustrated herein;

FIG. 7 schematically depicts a cross section of an example embodiment of a gripping member and a shell as a sub-assembly in a first uncompressed position according to one or more embodiments described and illustrated herein;

FIG. 8 schematically depicts a cross section of an example embodiment of a gripping member and a shell as a sub-assembly in a second compressed position according to one or more embodiments described and illustrated herein;

FIG. 9 schematically depicts a cross section of another example embodiment of a gripping member and a shell as a sub-assembly in a first uncompressed position according to one or more embodiments described and illustrated herein;

FIG. 10 schematically depicts a cross section of the example embodiment of the gripping member and the shell shown in FIG. 9 as a sub-assembly in a second compressed position according to one or more embodiments described and illustrated herein;

FIG. 11 schematically depicts a cross section of another example embodiment of a gripping member and a shell as a partially completed sub-assembly in a first uncompressed position according to one or more embodiments described and illustrated herein;

FIG. 12 schematically depicts a cross section of the gripping member and the shell as a sub-assembly in which a forming tool has been introduced to complete the sub-assembly according to one or more embodiments described and illustrated herein; and FIG. 13 schematically depicts a cross-section of the gripping member and the shell as sub-assembly in a final assembled condition with the forming tool removed according to one or more embodiments described and illustrated herein.

Reference will now be made in detail to various embodiment(s) of a coaxial cable connector, examples of which are illustrated in the accompanying drawings. Whenever possible, the same reference numerals will be used throughout the drawings to refer to the same or like parts.

DETAILED DESCRIPTION

Embodiments disclosed herein coaxial cable connectors used to connect a coaxial cable to an equipment port or terminal such that secure mechanical and electrical connections result. The terms "equipment port" and "terminal" may be used interchangeably herein. It should be understood that each of these terms shall mean or refer to any device or structure to which the coaxial cable connector attaches to mechanically and/or electrically connect a coaxial cable thereto. The coaxial cable connector includes attachment feature for attaching the coaxial cable connector to the equipment port or terminal. The attachment feature may be any suitable attachment device, including, without limitation, rotatable coupler, also referred to as a nut, or push-on component. A body is secured to the coupler at one end in a manner so that it does not rotate with coupler. A post is secured to and inside of the body. A shell is movably attached to the body at another end such that shell can axially move toward coupler. A gripping member is frictionally fit inside of shell. The shell accepts the coaxial cable which is inserted through shell and the gripping member and is secured to an end of post so that coaxial cable positions between post and body inside of body. The gripping member is configured to secure coaxial cable to coaxial cable connector. In this regard, when an axially compressive force is applied to shell to move shell axially toward coupler, the gripping member also moves and at least a part of gripping member is forced between body and coaxial cable.

The gripping member has a front end and a rear end opposite the front end, and an outer surface and an inner surface defining a longitudinal hole extending between the front end and the rear end. A first portion of the gripping member terminates at the front end. A second portion of the gripping member terminates at the rear end. The gripping member is configured to secure the coaxial cable to the coaxial cable connector. The gripping member secures the coaxial cable to the coaxial cable connector when at least part of the gripping member is forced under the body. The gripping member may be forced under body of a coaxial cable connector when driven axially forward by the shell to secure coaxial cable to the connector. When forced under the body, the first portion or front end the gripping member may be displaced radially inwardly. The shell includes a structure to move the rear end/second portion of the gripping member radially outwardly upon compression. In some embodiments, the shell includes a structure to prevent a rear portion of the gripping member from moving radially inwardly upon compression. In various embodiments, the structure may comprise, for example, a machined component, a stamped component such as a one- or multi-piece stamped component, or another structure adapted to move a rear portion of the gripping member radially outwardly upon compression and/or prevent a rear portion of the gripping member from moving radially inwardly upon compression. Various embodiments of connectors and coaxial cable assemblies are described in detail below.

Figure 1:
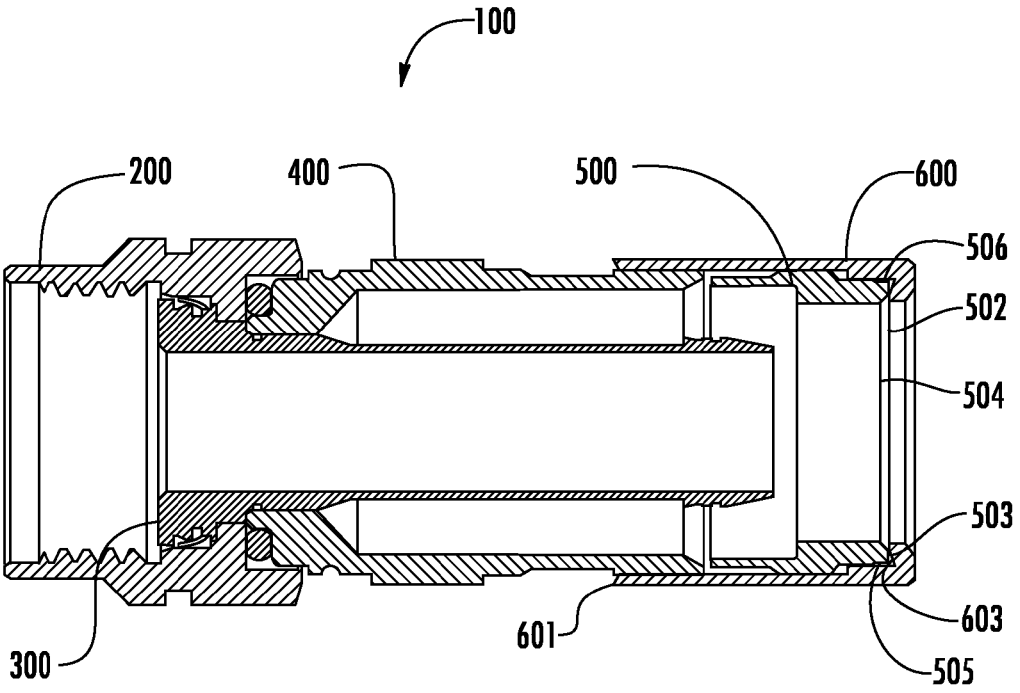
FIG. 1 schematically depicts a cross sectional view of an example embodiment of a coaxial cable connector for coupling an end of a coaxial cable to a terminal according to one or more embodiments described and illustrated herein.

A coaxial cable has a center or inner conductor that is surrounded by a dielectric layer. The dielectric layer (or dielectric) may also have a foil or other metallic covering. The coaxial cable then has a braided outer conductor which is covered and protected by a jacket. Typically, to prepare the coaxial cable for attachment to a coaxial cable connector, a portion of the center conductor is exposed. The jacket is trimmed back so that a portion of the dielectric (and metallic covering) and braided outer conductor are exposed. The braided outer conductor is then folded back over the jacket, to expose the dielectric (and the metallic covering if present). Whenever possible, the same reference numerals will be used throughout the drawings to refer to the same or like parts FIG. 1 schematically depicts a cross sectional view of an example embodiment of a coaxial cable connector 100 for coupling an end of a coaxial cable to a terminal. In this embodiment, the coaxial cable connector 100 includes a coupler 200 adapted to couple to the terminal. The coaxial cable connector 100 also includes a body 400 secured to the coupler 200 at one end in a manner so that the body 400 does not rotate with coupler 200. A post 300 is secured to and disposed inside of the body 400. A shell 600 is movably attached to the body 400 at an opposite end such that the shell 600 can axially move toward coupler 200. A gripping member 500 is frictionally fit inside of the shell 600. The shell 600 accepts the coaxial cable which is inserted through shell 600 and the gripping member 500 and is secured to an end of the post 300 so that the coaxial cable positions between the post 300 and the body 400 inside of the body. The gripping member 500 is configured to secure the coaxial cable to the coaxial cable connector 100. In this regard, when an axially compressive force is applied to the shell 600 to move the shell 600 axially toward the coupler 200, the gripping member 500 also moves and at least a part of the gripping member 500 is forced between the body 400 and the coaxial cable.

In one embodiment, the coupler 200, the post 300, the body 400, and the shell 600 may be made from a conductive material such as nickel plated brass or the like. The gripping member 500 may be made from a non-conducting material, such as a plastic such as acetal. The gripping member 500 at least partially includes a front portion 501, a back portion 502, a rearward facing surface 503, an internal surface 504, and a reduced diameter portion 505. The shell 600 at least partially includes a front end 601, a back end 602 and a surface 603. The reduced diameter portion 505 creates an annular gap 506 between the gripping member 500 and the shell 600. The surface 603 of the shell 600 is configured to drive the rearward facing surface 503 and at least a portion of the internal surface 504 of the gripping member 500 radially outwardly when driven axially against the rearward facing surface 503 by means of a reverse rake angle of the surface 603 oriented in a direction angled from the rear end 602 of the shell 600 toward the front end 601 of the shell 600 as the surface 603 extends from an inner surface of the shell 600 into a longitudinal opening defined by the shell 600.

Figure 2:
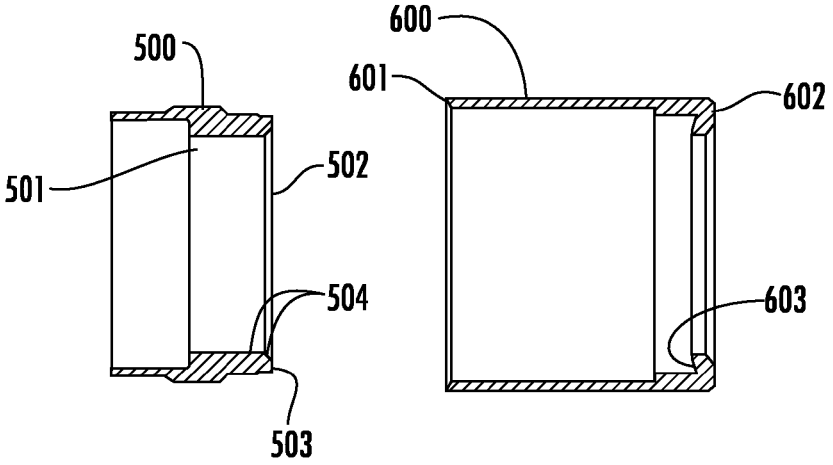
FIG. 2 schematically depicts a cross sectional view of an example embodiment of a gripping member and a shell of the coaxial cable connector shown in FIG. 1 in an unassembled state according to one or more embodiments described and illustrated herein.

FIG. 2 schematically depicts a cross sectional view of an example embodiment of a gripping member 500 and a shell 600 of the coaxial cable connector 100 shown in FIG. 1 in an unassembled state. As described above with reference to FIG. 1, the gripping member 500 includes a front portion 501, a back portion 502, a rearward facing surface 503, an internal surface 504, and a reduced diameter portion 505. The shell 600 at least partially includes a front end 601, a back end 602 and a surface 603. The reduced diameter portion 505 of the gripping member 500 creates an annular gap 506 between the gripping member 500 and the shell 600. The surface 603 of the shell 600 is configured to drive the rearward facing surface 503 and at least a portion of the internal surface 504 of the gripping member 500 radially outwardly when driven axially against the rearward facing surface 503 by means of a reverse rake angle of the surface 603 oriented in a direction angled from the rear end 602 of the shell 600 toward the front end 601 of the shell 600 as the surface 603 extends from an inner surface of the shell 600 into a longitudinal opening defined by the shell 600. Thus, in this embodiment, a distal end of the forward angled surface extends into the longitudinal opening of the shell and is disposed forward (i.e., closer to the front end 601) relative to a proximal end of the forward facing surface disposed at or near (e.g., at least generally adjacent to) the inner surface of the shell 600.

Figure 3:
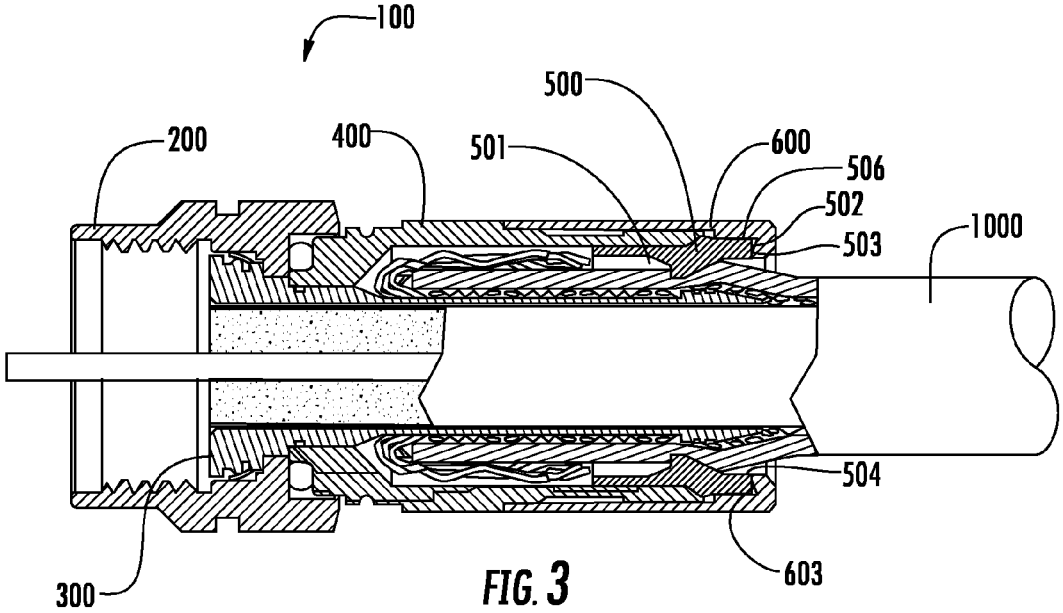
FIG. 3 schematically depicts the example embodiment of the coaxial cable connector shown in FIG. 1 with a coaxial cable inserted into the coaxial cable connector according to one or more embodiments described and illustrated herein.

FIG. 3 schematically depicts the example embodiment of the coaxial cable connector 100 shown in FIG. 1 with a coaxial cable 1000 inserted into the coaxial cable connector 100. In FIG. 3, the coaxial cable connector 100 is in a closed condition in which the shell 600 has been axially moved in a forward direction over the body 400 toward the coupler 200 of the connector 100. The front portion 501 of the gripping member 500 has been forced cylindrically into or under the body 400 and has been deformed radially inwardly towards the coaxial cable 1000. In one embodiment, for example, the front portion 501 of the gripping member contacts an outer jacket of the coaxial cable 1000 as shown in FIG. 3 and further environmentally seals the junction of the coaxial cable connector 100 and the coaxial cable 1000.

At least a portion of the rear portion 502, a portion of the internal surface 504, and a portion of the rearward facing surface 503 of the gripping member 500 have been forced at least partially radially outwardly by the angled surface 603 of the shell 600 as evidenced by a volumetric reduction in an annular gap 506 and by the general shape of the resulting component configuration.

Figure 4:
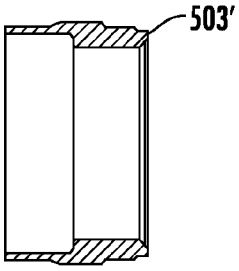
FIG. 4 schematically depicts a cross section of another example embodiment of a gripping member of a coaxial cable connector according to one or more embodiments described and illustrated herein.

FIG. 4 schematically depicts a cross section of another example embodiment of a gripping member 500' of a coaxial cable connector according to one or more embodiments. In the particular implementation shown in FIG. 4, for example, a rearward facing surface 503' of the gripping member 500' includes a reverse rake angle corresponding to the surface 603 of the shell 600 described above with respect to FIGS. 1 and 2. Thus, in the embodiment shown in FIG. 5, the rearward facing surface 503' is angled in a direction extending from the rear end 502 of the gripping member 500 toward the front portion 501 of the gripping member 500 as the surface extends from an inner surface of the gripping member 500 into a longitudinal opening of the gripping member 500.

FIG. 5 schematically depicts a cross section of another example embodiment of a gripping member 510 and a shell 610 of a coaxial cable connector as a sub-assembly in a first uncompressed position. In this embodiment, the gripping member 510 at least partially includes an outer ring 511 and an inner area 512. The shell 610 at least partially includes an angled surface 611 and a recess 612, such as formed by an annular channel in the shell 610. The recess 612 of the shell provides an annular gap 513 around the gripping member in this first uncompressed position.

FIG. 6 schematically depicts a cross section of the example embodiment of the gripping member 510 and the shell 610 shown in FIG. 5 as a sub-assembly in a second compressed position. In this embodiment, the shell 610 has been forced in an axially forward direction toward the gripping member 510 as it would be during compression of a coaxial cable connector. In this embodiment, at least a portion of the outer ring 511 and a portion of the inner area 512 of the gripping member 510 have been forced at least partially radially outwardly by the angled surface 611 of the shell 610 as evidenced by a volumetric reduction in annular gap 513, an increase in volumetric space around inner area 512, and by the general shape of the resulting component configuration.

FIG. 7 schematically depicts a cross section of an example embodiment of a gripping member 520 and a shell 620 as a sub-assembly in a first uncompressed position. In this embodiment, the gripping member 520 at least partially comprises a reduced diameter portion 521 and an inner area 522. The shell 620 at least partially includes an angled surface 621 and a bore 622. The reduced diameter portion 521 of the gripping member 520 creates annular gap 523 between the gripping member 520 and the bore 622 of the shell 620.

FIG. 8 schematically depicts a cross section of an example embodiment of a gripping member 520 and a shell 620 as a sub-assembly in a second compressed position. In this embodiment, the shell 620 has been forced in an axially forward direction toward the gripping member 520 as it would be during compression of a coaxial cable connector. As such, at least a portion of the reduced diameter portion 521 and a portion of the inner area 522 of the gripping member 520 have been forced at least partially radially outwardly by the angled surface 621 of the shell 620 as evidenced by a volumetric reduction in the annular gap 523, an increase in volumetric space around the inner area 522, and by the general shape of the resulting component configuration.

FIG. 9 schematically depicts a cross section of another example embodiment of a gripping member 530 and a shell 630 as a sub-assembly in a first uncompressed position. In this embodiment, the gripping member 530 at least partially comprises a reduced diameter portion 531 and an inner area 532. The shell 630 at least partially includes an angled surface 631 and a bore 632. The reduced diameter portion 531 of the gripping member 530 creates annular gap 533 between the gripping member 530 and the bore 632 of the shell 630. Additionally, in this implementation, the shell 630 may be produced by a stamping or deep draw operation that is more economical to produce than a shell made by machining or turning operations.

FIG. 10 schematically depicts a cross section of the example embodiment of the gripping member 530 and the shell 630 shown in FIG. 9 as a sub-assembly in a second compressed position. In this embodiment, the shell 630 has been forced in an axially forward direction toward the gripping member 530 as it would be during compression of a coaxial cable connector. As such, at least a portion of the reduced diameter portion 531 and a portion of the inner area 532 of the gripping member 520 have been forced at least partially radially outwardly by the angled surface 631 of the shell 630 as evidenced by a volumetric reduction in the annular gap 533, an increase in volumetric space around the inner area 532, and by the general shape of the resulting component configuration.

FIG. 11 schematically depicts a cross section of another example embodiment of a gripping member 540 and a shell 640 as a partially completed sub-assembly in a first uncompressed position. In this embodiment, the gripping member 540 at least partially includes an outer diameter 541 and an inner area 542. The shell 640 at least partially includes a structure 641 such as a curved forward facing surface and a bore 642. Additionally, in this implementation, the shell 640 may be produced by a stamping or deep draw operation that is more economical to produce than a shell made by machining or turning operations.

FIG. 12 schematically depicts a cross section of the gripping member 540 and the shell 640 as a sub-assembly in which a forming tool 2000 has been introduced to complete the sub-assembly by forming the structure 641 (e.g., the curved forward facing surface) of the shell 600 radially outwardly. The forming operation captures the gripping member 540 within the shell 640 and creates an annular barrier to prevent the inner area 542 of the gripping member 540 from moving radially inwardly.

FIG. 13 schematically depicts a cross-section of the gripping member 540 and the shell 640 as sub-assembly in a final assembled condition with the forming tool 2000 removed.

It should now be understood that embodiments described herein are directed to coaxial cable connectors and methods connecting coaxial cable connectors to a coaxial cable.

For the purposes of describing and defining the subject matter of the disclosure it is noted that the terms "substantially" and "generally" are utilized herein to represent the inherent degree of uncertainty that may be attributed to any quantitative comparison, value, measurement, or other representation.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the disclosure. Since modifications, combinations, sub-combinations and variations of the disclosed embodiments incorporating the spirit and substance of the disclosure may occur to persons skilled in the art, the embodiments disclosed herein should be construed to include everything within the scope of the appended claims and their equivalents.

What is claimed is:

1. A coaxial cable connector for connecting a coaxial cable comprising an inner conductor, an insulator layer surrounding the inner conductor, an outer conductor layer surrounding the insulator layer and an outer jacket, the coaxial cable connector comprising:

a body comprising a rear end, a front end, and an internal surface extending between the rear and front ends of the body, the internal surface defining a longitudinal opening;

a shell comprising a rear end, a front end surrounding at least a portion of the body, an inner surface defining a longitudinal opening extending between the rear and front ends of the shell, and a forwardly angled surface, the shell being axially movable over an outside portion of the body between a first rearward position and a second forward position; and a gripping member adapted to secure a coaxial cable to the coaxial cable connector, the gripping member disposed at least partially within the longitudinal opening of the shell, the gripping member comprising a front end, a rear end, an outer surface, and an inner surface defining an opening therein, wherein the forward angled surface of the shell is adapted to displace at least a portion of the rear end of the gripping member radially outwardly as the shell is moved from the first rearward position toward the second forward position.

2. The connector of claim 1 wherein the connector comprises a post disposed at least partially within the longitudinal opening of the body, the post having a rear end, an inner surface and an outer surface, and wherein the outer surface of the post and the internal surface of the post define an annular cavity therebetween.

3. The connector of claim 1 wherein the gripping member is disposed within the longitudinal opening of the shell between the front and rear ends of the shell.

4. The connector of claim 1 wherein the forward angled surface of the shell comprises a reverse rake angled surface.

5. The connector of claim 4 wherein the forward angled surface is oriented in a direction angled from the rear end of the shell toward the front end of the shell.

6. The connector of claim 1 wherein the forward angled surface comprises a machined surface of the shell.

7. The connector of claim 1 wherein the forward angled surface comprises a stamped surface of the shell.

8. The connector of claim 1 wherein the forward angled surface comprises a rolled surface of the shell.

9. The connector of claim 1 wherein the forward angled surface of the shell comprises a curved forward facing surface.

10. The connector of claim 1 wherein a distal end of the forward angled surface extends into the longitudinal opening of the shell and is disposed forward relative to a proximal end of the forward facing surface.

11. A method for securing a coaxial cable to a coaxial cable connector, the method comprising:

inserting a coaxial cable through an inner bore of a body, shell and gripping member of the coaxial cable connector, wherein the body comprises a rear end, a front end, and an internal surface extending between the rear and front ends of the body, the internal surface defining a longitudinal opening, wherein the shell comprises a rear end, a front end surrounding at least a portion of the body, an inner surface defining a longitudinal opening extending between the rear and front ends of the shell and a forwardly angled surface, the shell being axially movable over an outside portion the body between a first rearward position and a second forward position, and wherein the gripping member is disposed at least partially within the longitudinal opening of the shell, the gripping member comprising a front end, a rear end, an outer surface, and an inner surface defining an opening therein; and axially sliding the shell in a forward direction relative to the body, wherein the forward angled surface of the shell is adapted to displace at least a portion of the rear end of the gripping member radially outwardly as the shell is moved from the first rearward position toward the second forward position.

12. The method of claim 11, further comprising forming the forward angled surface of the shell with a forming tool.

13. The method of claim 12, further comprising forming the forward angled surface of the shell to displace the portion of the rear end of the gripping member radially outwardly.

14. The method of claim 11 wherein the connector further comprises a post disposed at least partially within the longitudinal opening of the body, the post having a rear end, an inner surface and an outer surface, and wherein the outer surface of the post and the internal surface of the post define an annular cavity therebetween.

15. The method of claim 11 wherein the forward angled surface of the shell comprises a reverse rake angled surface.

16. The method of claim 15 wherein the forward angled surface is oriented in a direction angled from the rear end of the shell toward the front end of the shell.

17. The method of claim 11 wherein the forward angled surface comprises a machined surface of the shell.

18. The method of claim 11 wherein the forward angled surface comprises a stamped surface of the shell.

19. The method of claim 11 wherein the forward angled surface comprises a rolled surface of the shell.

20. The method of claim 11 wherein the forward angled surface of the shell comprises a curved forward facing surface.

* * * * *